US011787018B2

(12) United States Patent
Tsai

(10) Patent No.: US 11,787,018 B2
(45) Date of Patent: Oct. 17, 2023

(54) ROTATION WRENCH

(71) Applicant: Chang-Yu Tsai, Taichung (TW)

(72) Inventor: Chang-Yu Tsai, Taichung (TW)

( * ) Notice: Subject to any disclaimer, the term of this patent is extended or adjusted under 35 U.S.C. 154(b) by 93 days.

(21) Appl. No.: 17/695,963

(22) Filed: Mar. 16, 2022

(65) Prior Publication Data

US 2023/0294256 A1 Sep. 21, 2023

(51) Int. Cl.
*B25B 23/00* (2006.01)
*B25B 13/46* (2006.01)

(52) U.S. Cl.
CPC ..... *B25B 23/0028* (2013.01); *B25B 13/461* (2013.01)

(58) Field of Classification Search
CPC ..... B25B 23/0028; B25B 13/461
USPC ..... 81/177.8, 177.9
See application file for complete search history.

(56) References Cited

U.S. PATENT DOCUMENTS 2,977,824 A 4/1961 Rueb
8,505,419 B2 * 8/2013 Cheng ..... B25G 1/063 81/177.85
9,808,917 B1 * 11/2017 Chien ..... B25G 3/04
2017/0361450 A1 * 12/2017 Chien ..... B25G 1/063

* cited by examiner

*Primary Examiner* — Hadi Shakeri

(57) ABSTRACT

A wrench includes a main body, a mounting member, a push rod, two push blocks, a first elastic member, a handle, and a drive mechanism. The main body has a support arm, two pivoting portions, a rotation passage, a first receiving hole, a first receiving slot, two second receiving slots, a second receiving hole, and a shank. The push rod has a positioning element. Each of the push blocks has a first received portion, a second received portion, a third mounting portion, a first locking section, a second locking section, a first locking groove, and a second locking groove. The drive mechanism has a driving head, a control rod, and a second elastic member. The driving head has two fitting portions, a third receiving hole, multiple first positioning portions, and an operation end. The control rod has a second positioning portion and a stepped portion.

6 Claims, 13 Drawing Sheets

A-A

A-A

A-A

A-A

A-A

A-A

A-A

ROTATION WRENCH

BACKGROUND OF THE INVENTION

1. Field of the Invention

The present invention relates to a hand tool and, more particularly, to a rotation wrench.

2. Description of the Related Art

A conventional rotation wrench was disclosed in the U.S. Pat. No. 2,977,824, and comprises a wrench handle 10, a wrench head 20, and a screw 32. The wrench handle 10 has a yoke 14 having two yoke arms 14*a*. The wrench head 20 is forced into the yoke 14 of the wrench handle 10 and clamped between the yoke arms 14*a* of the wrench handle 10. The screw 32 is screwed into screw holes of the wrench handle 10 so that the two yoke arms 14*a* will not be spread outward.

However, the conventional wrench has the following disadvantages.

1. The wrench head 20 is not positioned on the wrench handle 10 so that when the wrench head 20 is mounted on a socket for operating a workpiece, the wrench head 20 is easily rotated relative to the wrench handle 10, thereby causing inconvenience to the user during operation.
2. When the wrench head 20 is to be mounted on the wrench handle 10, it is necessary to spread or stretch the yoke arms 14*a* of the wrench handle 10, so as to place the wrench head 20 into the yoke arms 14*a* of the wrench handle 10, so that the yoke 14 of the wrench handle 10 is easily broken.
3. The wrench head 20 has a periphery provided with two opposite trunnions 22 pivotally mounted on the yoke arms 14*a* of the wrench handle 10, so that the wrench head 20 is pivoted relative to the wrench handle 10 about the two trunnions 22. However, the wrench head 20 has a protruding mounting portion that is moved to touch the wrench handle 10 during rotation of the wrench head 20, thereby interrupting rotation of the wrench head 20, so that the wrench head 20 cannot be rotated through 360 degrees relative to the wrench handle 10.

BRIEF SUMMARY OF THE INVENTION

In accordance with the present invention, there is provided a wrench comprising a main body, two fitting members, a mounting member, a push rod, two push blocks, a first elastic member, a handle, and a drive mechanism. The main body has a support arm, two pivoting portions, a rotation passage, a first receiving hole, a first receiving slot, two second receiving slots, a second receiving hole, and a shank. The two fitting members are mounted on the two pivoting portions respectively. The push rod has a positioning element and a second mounting portion. Each of the two push blocks has a first received portion, a second received portion, a third mounting portion, a first locking section, a second locking section, a first locking groove, and a second locking groove. The drive mechanism has a driving head, a control rod, and a second elastic member. The driving head has two fitting portions, a third receiving hole, multiple first positioning portions, and an operation end. The control rod has a second positioning portion and a stepped portion.

According to the primary advantage of the present invention, the two push blocks have the same structure. The two push blocks are combined mutually and mounted in the first receiving slot so that the two push blocks are assembled securely and will not be detached from the first receiving slot.

According to another advantage of the present invention, the first locking section of one of the two push blocks is received in the first locking groove of the other one of the two push blocks, and the second locking section of the one of the two push blocks is locked in the second locking groove of the other one of the two push blocks, so that the two push blocks are assembled without detachment.

According to a further advantage of the present invention, the two push blocks are arranged on top and bottom sides of the main body respectively, so that when the driving head of the drive mechanism is rotated to any angle, one of the two push blocks is used to control movement of the push rod, thereby facilitating the user operating the wrench ergonomically.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
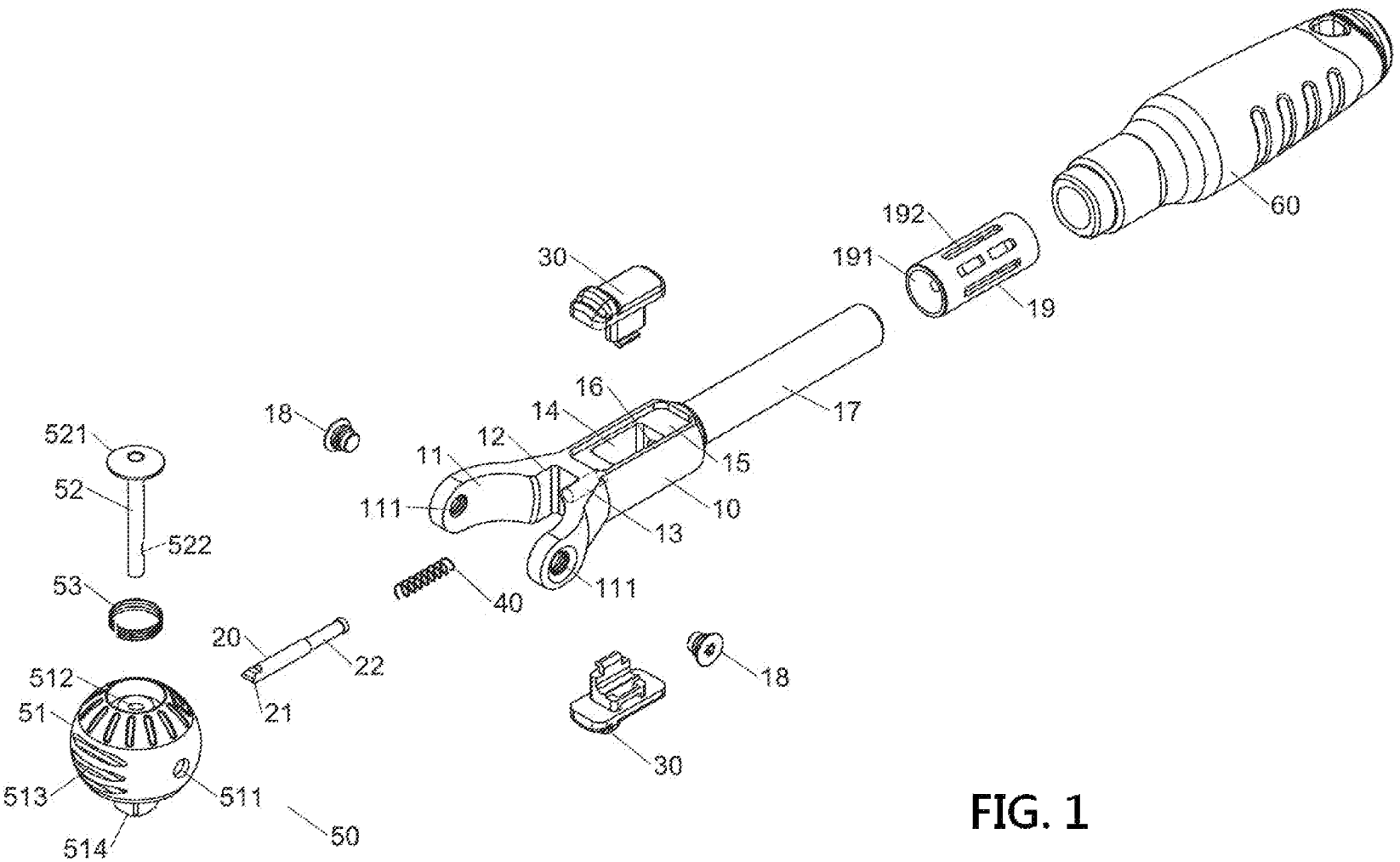
FIG. 1 is an exploded perspective view of a wrench in accordance with the preferred embodiment of the present invention.
Figure 2:
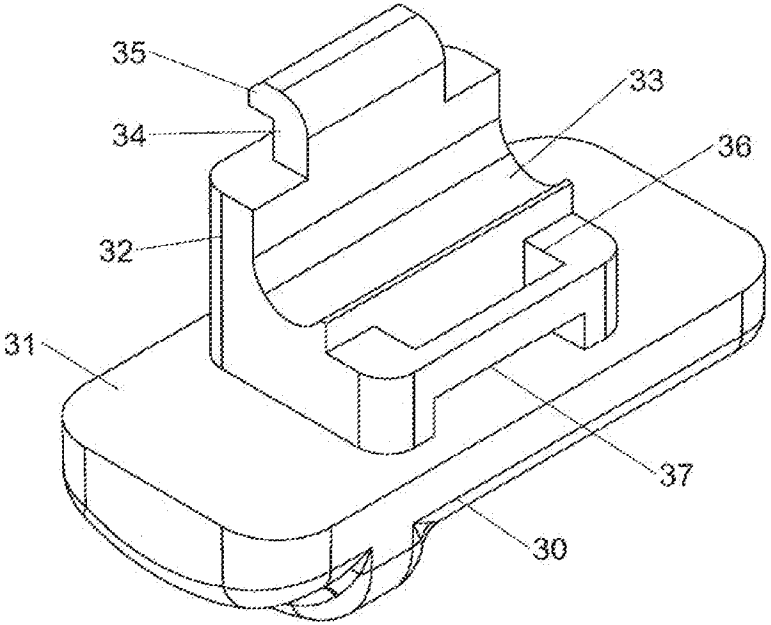
FIG. 2 is a perspective view of a push block of the wrench in accordance with the preferred embodiment of the present invention.
Figure 3:
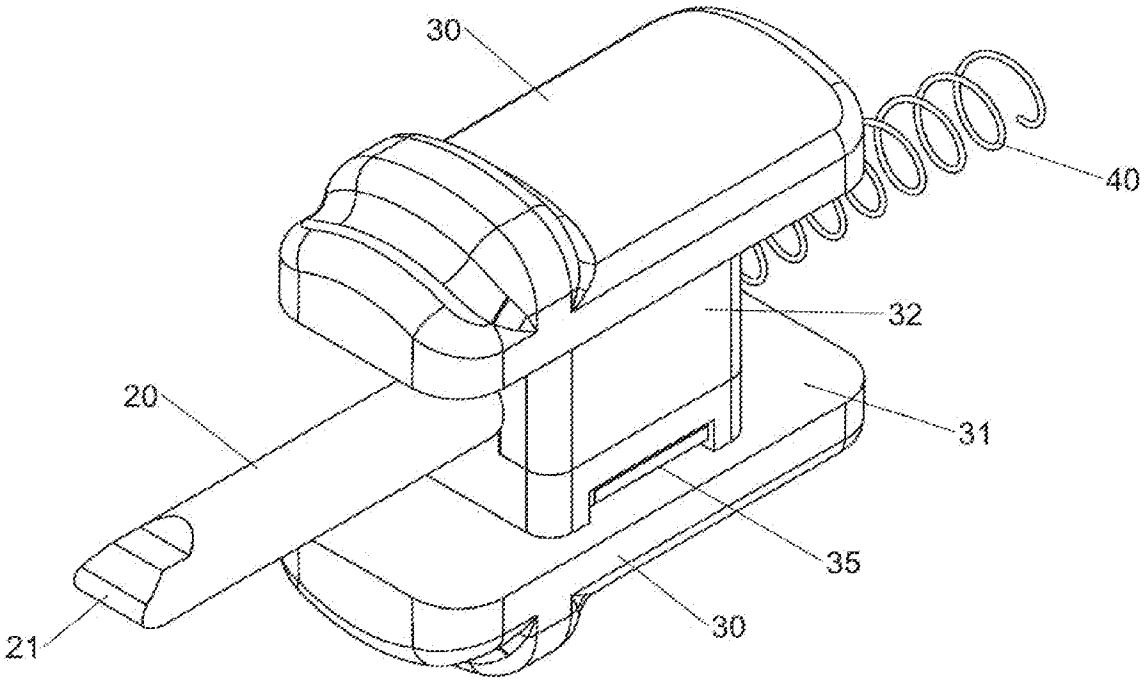
FIG. 3 is a partial perspective assembly view of the wrench in accordance with the preferred embodiment of the present invention.
Figure 4:
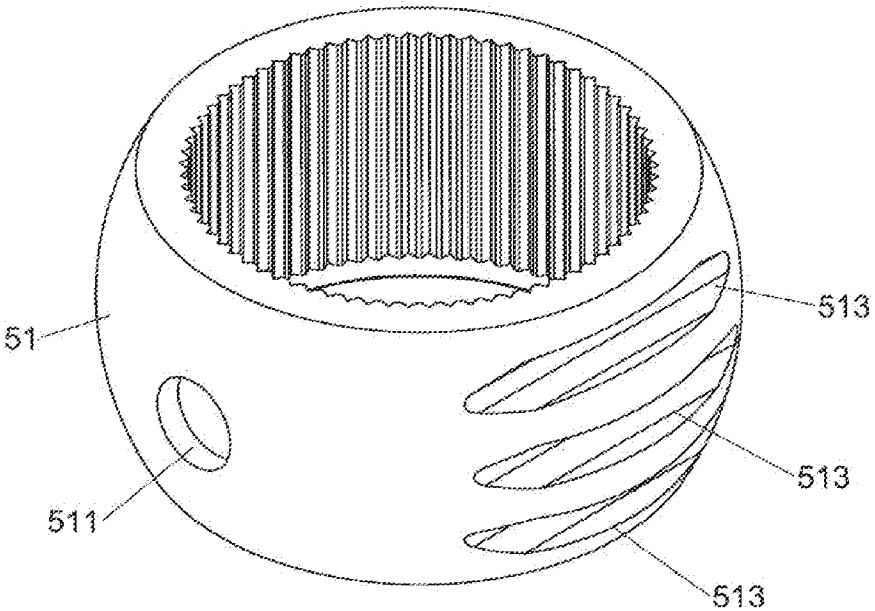
FIG. 4 is a perspective view of a driving head of the wrench in accordance with the preferred embodiment of the present invention.
Figure 5:
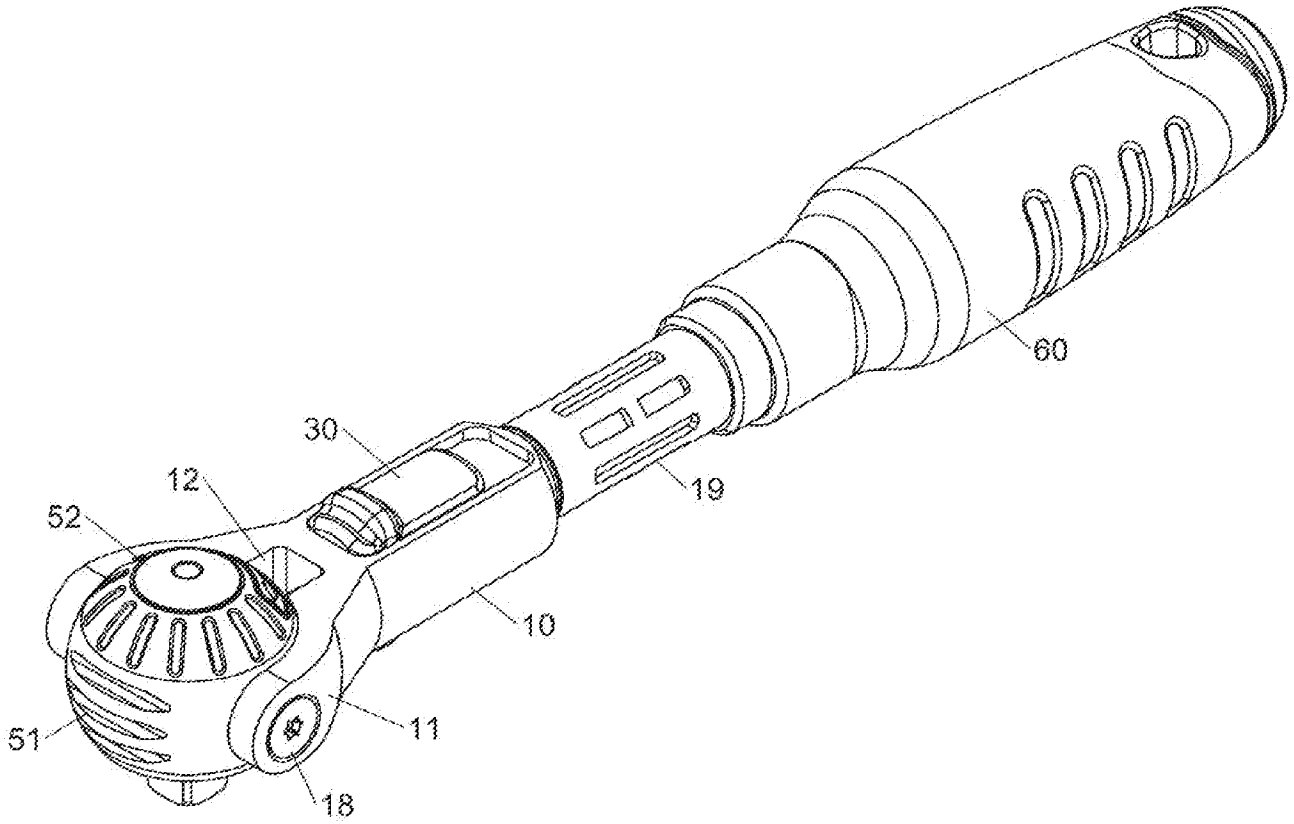
FIG. 5 is a perspective assembly view of the wrench in accordance with the preferred embodiment of the present invention.
Figure 6:
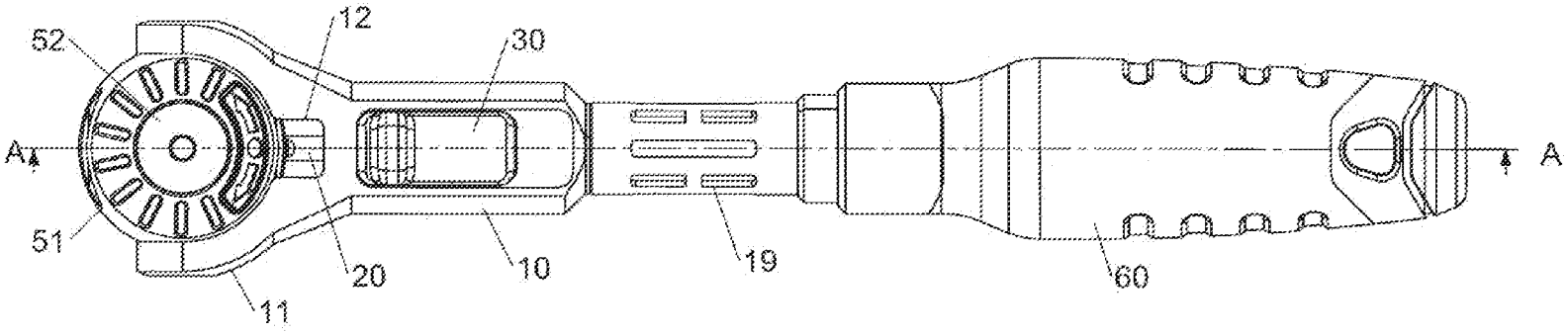
FIG. 6 is a top view of the wrench as shown in FIG. 5.
Figure 7:
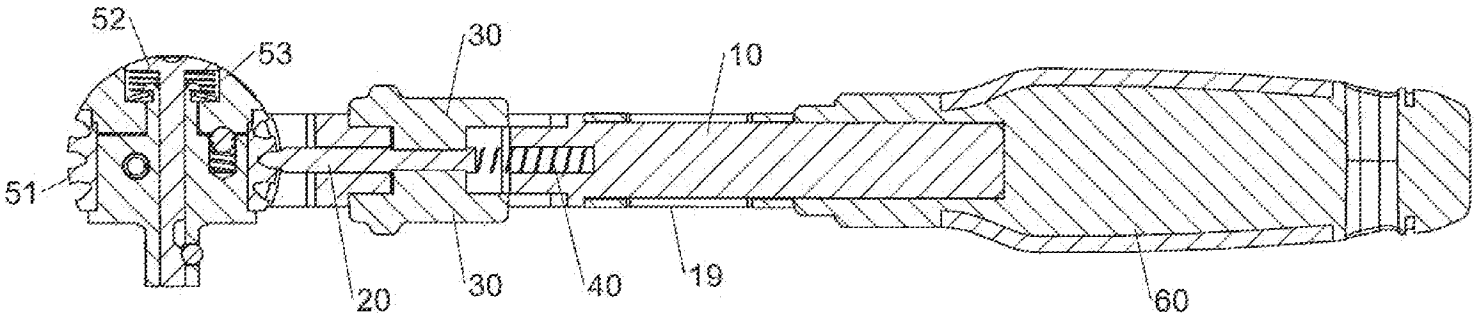
FIG. 7 is a cross-sectional view of the wrench taken along line A-A as shown in FIG. 6, wherein the wrench is disposed at a first operation state.

Referring to the drawings and initially to FIGS. 1-7, a wrench in accordance with the preferred embodiment of the present invention comprises a main body 10, two fitting members 18, a mounting member 19, a push rod 20, two push blocks 30, a first elastic member 40, a handle 60, and a drive mechanism 50.

The main body 10 has a first end provided with a support arm 11. The support arm 11 has a substantially Y-shaped configuration. The support arm 11 has two pivoting portions 111 provided on two ends thereof. Each of the two pivoting portions 111 is a perforation. Each of the two pivoting portions 111 has an internal thread. The main body 10 is provided with a rotation passage 12. The rotation passage 12 is arranged at a bottom of the support arm 11. The rotation passage 12 has a determined width and a determined depth. The rotation passage 12 has a rectangular shape and penetrates a whole thickness of the main body 10. The main body 10 is provided with a first receiving hole 13. The first receiving hole 13 is arranged at the bottom of the support arm 11. The first receiving hole 13 is connected to the rotation passage 12. The first receiving hole 13 is a perforation. The main body 10 is provided with a first receiving slot 14. The first receiving slot 14 is connected to the first receiving hole 13. The first receiving slot 14 is a perforation. The first receiving slot 14 has two second receiving slots 15 provided on two end faces thereof. Each of the two second receiving slots 15 is connected to the first receiving slot 14. Each of the two second receiving slots 15 has a length more than that of the first receiving slot 14 and has a width more than that of the first receiving slot 14. The first receiving slot 14 is provided with a second receiving hole 16. The second receiving hole 16 aligns with the first receiving hole 13. The second receiving hole 16 is coaxial with the first receiving hole 13. The second receiving hole 16 has a circular shape. The main body 10 has a second end provided with a shank 17. The shank 17 has a circular shape.

The two fitting members 18 are mounted on the two pivoting portions 111 respectively. Each of the two fitting members 18 has an end extending into and protruding from the support arm 11. Each of the two fitting members 18 is a screw member.

The mounting member 19 is provided with a first mounting portion 191. The first mounting portion 191 is pivotally mounted on the shank 17. The mounting member 19 is provided with a plurality of grooves 192. The grooves 192 increase a friction between the main body 10 and a user's hand. The grooves 192 are arranged annularly.

The push rod 20 is mounted in the first receiving hole 13. The push rod 20 is movable in the first receiving hole 13. The push rod 20 has a first end provided with a positioning element 21. The positioning element 21 protrudes from the first receiving hole 13. The push rod 20 has a second end provided with a second mounting portion 22. The second mounting portion 22 extends into the first receiving slot 14. The second mounting portion 22 has a diameter less than that of the push rod 20.

The two push blocks 30 are combined mutually and mounted in the first receiving slot 14 without detachment. The two push blocks 30 are moved linearly in the first receiving slot 14 and drive the push rod 20 to move axially in the first receiving hole 13. Each of the two push blocks 30 is provided with a first received portion 31 received in one of the of the two second receiving slots 15. Each of the two push blocks 30 is provided with a second received portion 32 received in the first receiving slot 14. The second received portion 32 of each of the two push blocks 30 is provided with a third mounting portion 33. The third mounting portions 33 of the two push blocks 30 are mounted on the second mounting portion 22 respectively, so that the two push blocks 30 and the push rod 20 are assembled. The two push blocks 30 drive the push rod to move axially. The second received portion 32 of each of the two push blocks 30 has a first end provided with a first locking section 34 and a second locking section 35. The first locking section 34 and the second locking section construct an L-shaped piece. The second received portion 32 of each of the two push blocks 30 has a second end provided with a first locking groove 36 and a second locking groove 37. The first locking groove 36 and the second locking groove 37 construct an L-shaped channel. The first locking section 34 of one of the two push blocks 30 is received in the first locking groove 36 of the other one of the two push blocks 30, and the second locking section 35 of the one of the two push blocks 30 is locked in the second locking groove 37 of the other one of the two push blocks 30, so that the two push blocks 30 are assembled.

The first elastic member 40 is mounted in the second receiving hole 16. The first elastic member 40 is biased elastically between a bottom of the second receiving hole 16 and the push rod 20. The first elastic member 40 provides a restoring force to the push rod 20 when the push rod 20 is moved in the main body 10.

The handle 60 is mounted on the shank 17. The handle 60 restricts the mounting member 19.

The drive mechanism 50 is pivotally mounted on the support arm 11. The drive mechanism 50 is provided with a "PUSH" structure that is normal in the hand tool industry. The drive mechanism 50 is operated in a two-way manner or in a one-way manner. The drive mechanism 50 includes a driving head 51, a control rod 52, and a second elastic member 53.

The driving head 51 is provided with two fitting portions 511. The two fitting portions 511 align with the two pivoting portions 111 respectively. Each of the two fitting members 18 extends through one of the two pivoting portions 111 and is fitted into one of the two fitting portions 511, so that the driving head 51 is pivotally mounted on the two pivoting portions 111. The driving head 51 is rotated on the support arm 11 with the two pivoting portions 111 functioning an axis. The driving head 51 is provided with a third receiving hole 512. The third receiving hole 512 has an axis perpendicular to that of the two fitting portions 511. The third receiving hole 512 penetrates the driving head 51. The driving head 51 has an outer face provided with multiple first positioning portions 513. The first positioning portions 513 are arranged between the two fitting portions 511. Each of the first positioning portions 513 is movable to align with the positioning element 21. The positioning element 21 pushes and locates one of the first positioning portions 513, so that the driving head 51 is positioned on the main body 10 by the push rod 20. Preferably, the driving head 51 has three first positioning portions 513, and each of the first positioning portions 513 is a cavity (or dimple or cutout). The driving head 51 is provided with an operation end 514. The operation end 514 passes the rotation passage 12 when the driving head 51 is rotated, so that the driving head 51 is rotated through 360 degrees.

When the two push blocks 30 are pushed toward the handle 60 and moved through a maximum distance, the push rod 20 is driven and moved by the two push blocks 30, and the positioning element 21 is retracted into and hidden in the first receiving hole 13, so that the operation end 514 is moved to pass the rotation passage 12.

The control rod 52 is mounted in the third receiving hole 512. The control rod 52 has a first end provided with a second positioning portion 521. The second positioning portion 521 has a recess. The positioning element 21 pushes and locates the second positioning portion 521. When the push rod 20 is moved, the second positioning portion 521 is pushed and moved, and the control rod 52 is moved in the third receiving hole 512. The control rod 52 has a second end provided with a stepped portion 522. The stepped portion 522 is moved to align with the operation end 514 so that a socket mounted on the operation end 514 is removed quickly.

The second elastic member 53 is mounted on the control rod 52. The second elastic member 53 is biased between mounted on the control rod 52 the second positioning portion 521 and the driving head 51 so that the control rod 52 is movably elastically.

In assembly, the mounting member 19 is mounted on the shank 17. The push rod 20 is mounted in the first receiving hole 13. The two push blocks are combined and are assembled with the main body 10 and the push rod 20. The first elastic member 40 is mounted in the second receiving hole 16. The drive mechanism 50 is pivotally connected with the main body 10. The handle 60 is mounted on the shank 17.

Figure 8:
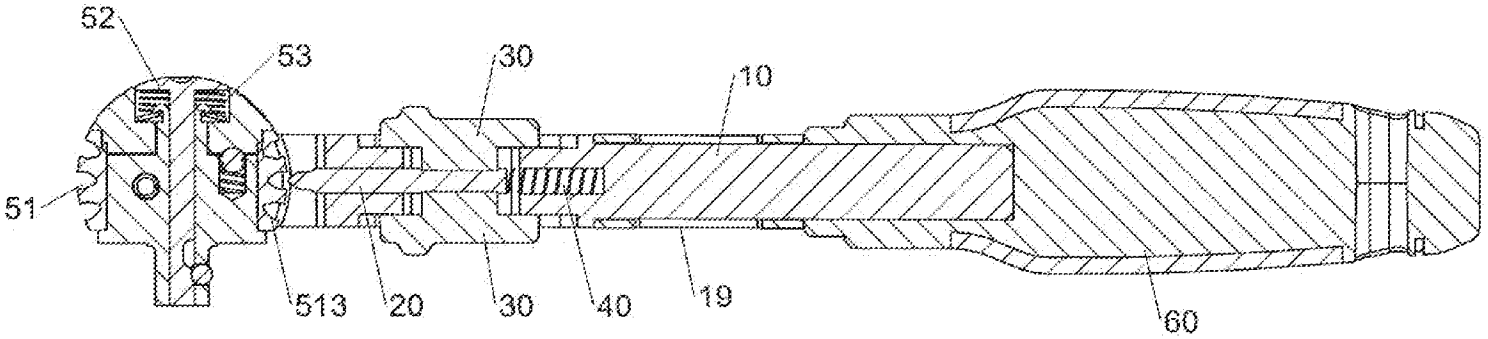
FIG. 8 is a schematic operational view of the wrench as shown in FIG. 7, wherein the wrench is disposed at a second operation state.
Figure 9:
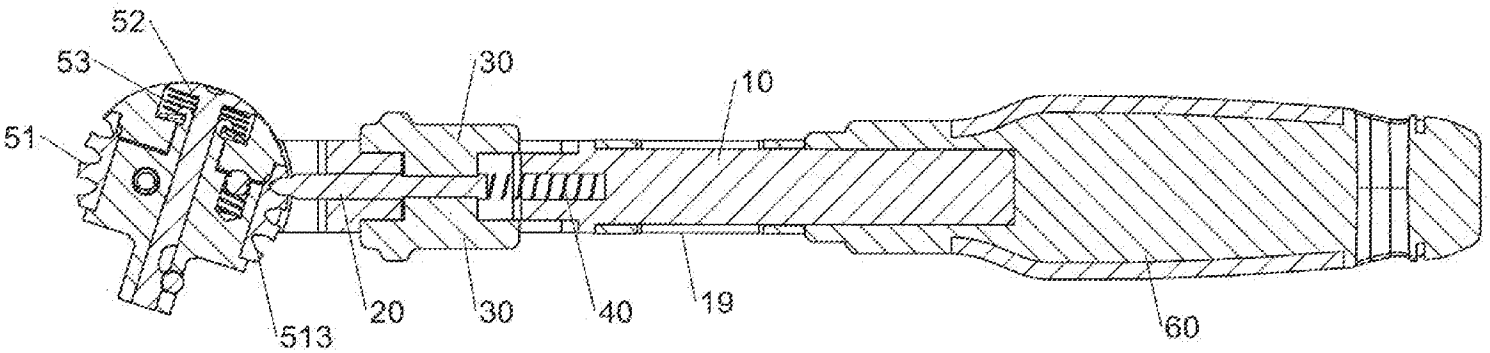
FIG. 9 is a schematic operational view of the wrench as shown in FIG. 8, wherein the wrench is disposed at a third operation state.

In operation, referring to FIGS. 8 and 9 with reference to FIGS. 1-7, when the two push blocks 30 are pushed toward the handle 60 by an external force and moved through a determined distance, the push rod 20 is driven and moved by the two push blocks 30, the first elastic member 40 is compressed by the push rod 20, and the positioning element 21 is moved backward and detached from one of the first positioning portions 513, so that the driving head 51 is unlocked from the positioning element 21, and is rotated freely on the support arm 11 with the two pivoting portions 111 functioning an axis. When the driving head 51 is rotated relative to the support arm 11 of the main body 10, another one of the first positioning portions 513 of the driving head 51 is moved to align with the positioning element 21 of the push rod 20. When the external force applied on the two push blocks 30 disappears, the push rod 20 and the two push blocks 30 are pushed by the restoring force of the first elastic member 40, and the positioning element 21 is moved into and positioned in another one of the first positioning portions 513, so that the driving head 51 is locked by the positioning element 21 and cannot be rotated relative to the positioning element 21. Thus, a fixed angle is defined between the driving head 51 of the drive mechanism 50 and the main body 10.

Figure 10:
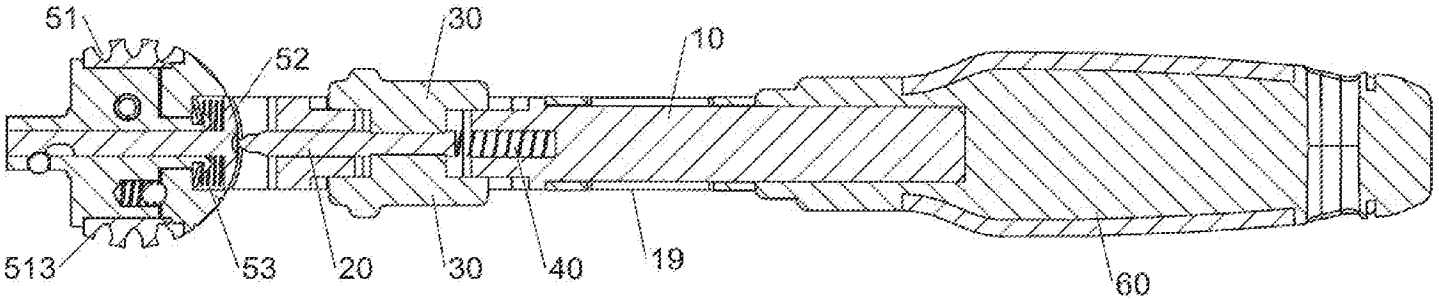
FIG. 10 is a schematic operational view of the wrench as shown in FIG. 9, wherein the wrench is disposed at a fourth operation state.
Figure 11:
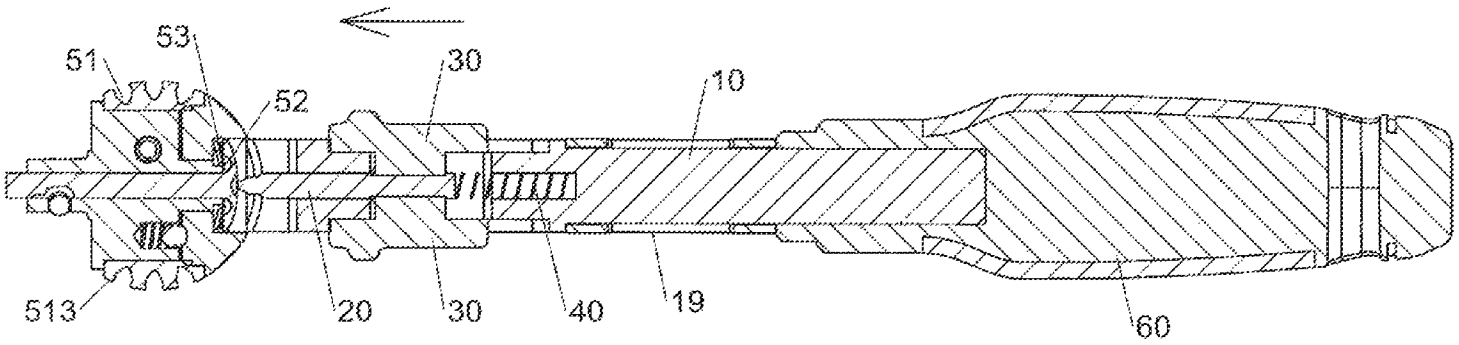
FIG. 11 is a schematic operational view of the wrench as shown in FIG. 10, wherein the wrench is disposed at a fifth operation state.

Referring to FIGS. 10 and 11 with reference to FIGS. 1-7, when the second positioning portion 521 aligns with the positioning element 21, the two push blocks 30 are pushed toward the drive mechanism 50 and moved through a determined distance, and the positioning element 21 is moved to press the second positioning portion 521, so that the control rod 52 is pushed and moved by the push rod 20, and the second elastic member 53 is compressed. Thus, the push rod 20 controls the drive mechanism 50 to operate. When the stepped portion 522 is moved to align with the operation end 514, the socket mounted on the operation end 514 is removed quickly.

Figure 12:
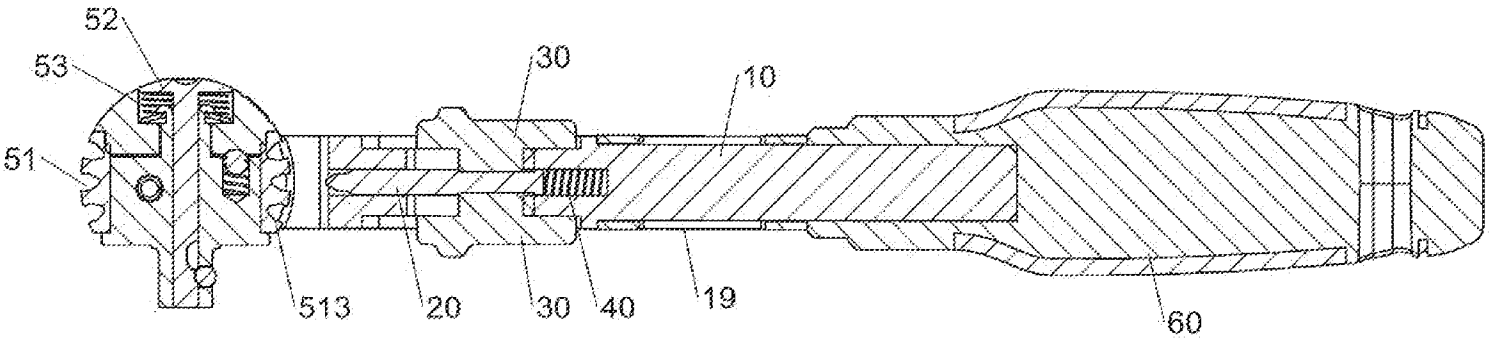
FIG. 12 is a schematic operational view of the wrench as shown in FIG. 8, wherein the wrench is disposed at a sixth operation state.
Figure 13:
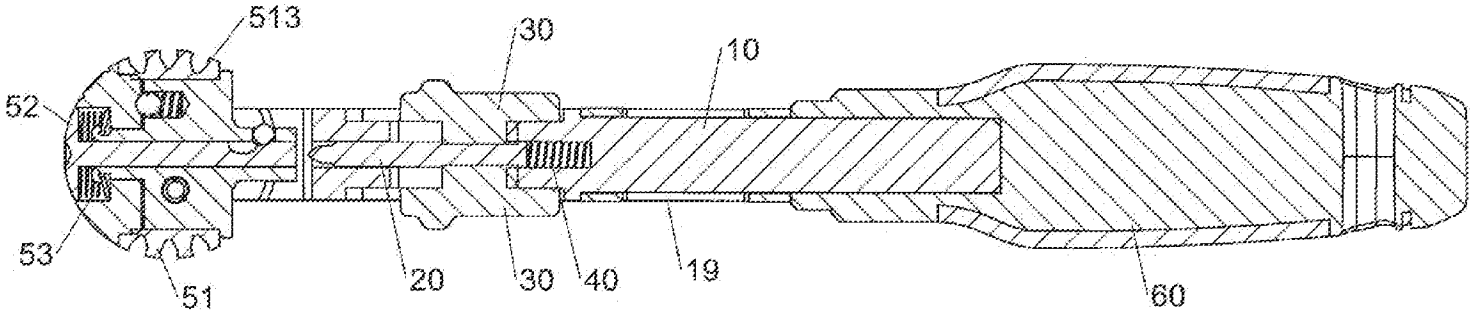
FIG. 13 is a schematic operational view of the wrench as shown in FIG. 12, wherein the wrench is disposed at a seventh operation state.

Referring to FIGS. 12 and 13 with reference to FIGS. 1-7, when the two push blocks 30 are pushed toward the handle 60 by an external force and moved through a long distance, the push rod 20 is also driven and moved toward the handle 60, so that the positioning element 21 is retracted into the first receiving hole 13. At this time, the rotation passage 12 is a perforation. Thus, the operation end 514 is moved to pass the rotation passage 12 when the driving head 51 is rotated relative to the support arm 11, so that the driving head 51 is rotated freely through 360 degrees relative to the support arm 11.

Figure 14:
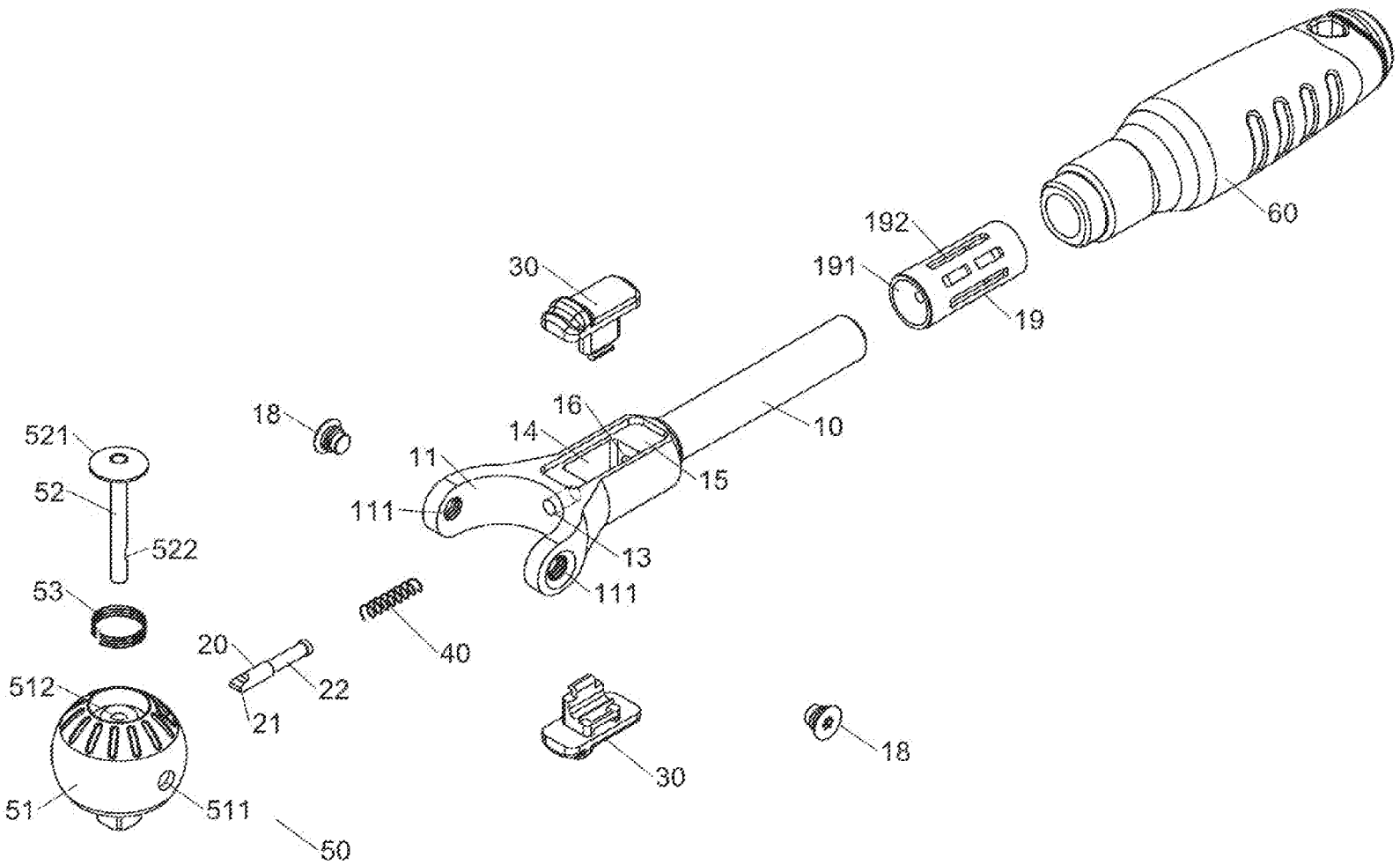
FIG. 14 is an exploded perspective view of a wrench in accordance with another preferred embodiment of the present invention.

Referring to FIG. 14 with reference to FIGS. 1-7, the rotation passage 12 of the main body 10 is undefined. Thus, the driving head 51 of the drive mechanism 50 cannot be rotated freely relative to the support arm 11 through 360 degrees.

In another preferred embodiment of the present invention, the operation end 514 is a hexagonal head, a square recess or a hexagonal recess. Accordingly, the wrench has the following advantages.

1. The two push blocks 30 have the same structure. The two push blocks 30 are combined mutually and mounted in the first receiving slot 14 so that the two push blocks 30 are assembled securely and will not be detached from the first receiving slot 14.
2. The first locking section 34 of one of the two push blocks 30 is received in the first locking groove 36 of the other one of the two push blocks 30, and the second locking section 35 of the one of the two push blocks 30 is locked in the second locking groove 37 of the other one of the two push blocks 30, so that the two push blocks 30 are assembled without detachment.
3. The two push blocks 30 are arranged on top and bottom sides of the main body 10 respectively, so that when the driving head 51 of the drive mechanism 50 is rotated to any angle, one of the two push blocks 30 is used to control movement of the push rod 20, thereby facilitating the user operating the wrench ergonomically.
4. The positioning element 21 presses and locates one of the first positioning portions 513 or the second positioning portion 521, so that the driving head 51 is locked by the push rod 20 and cannot be rotated relative to the main body 10. Thus, the drive mechanism 50 has a positioning function so that diverse angles are defined between the drive mechanism 50 and the main body 10.
5. When the two push blocks 30 are pushed toward the handle 60 and moved through the maximum distance, the push rod 20 is driven and moved by the two push blocks 30, and the positioning element 21 is retracted into and hidden in the first receiving hole 13, so that the operation end 514 is moved to pass the rotation passage 12. Thus, the driving head 51 is pivoted about the two pivoting portions 111 and the two fitting members 18, so that the driving head 51 is rotated freely relative to the support arm 11 and moved through 360 degrees, thereby facilitating the user operating the wrench.
6. The driving head 51 is pivoted about the two pivoting portions 111 and the two fitting portions 511, so that the driving head 51 is rotated relative to the support arm 11 to adjust the working angle of the wrench. Thus, the wrench is operated in multiple directions.
7. When the second positioning portion 521 aligns with the positioning element 21, the two push blocks 30 are pushed toward the drive mechanism 50 to move the push rod 20 toward the drive mechanism 50, and the positioning element 21 is moved to press the second positioning portion 521, so that the control rod 52 is locked by the push rod 20, and the operation end 514 is directly rotated by the main body 10. When the control rod 52 is pushed and moved by the push rod 20, the stepped portion 522 is moved to align with the operation end 514, so that the socket mounted on the operation end 514 is removed quickly.

8. When the two push blocks 30 are pushed toward the handle 60, the two push blocks 30 are moved through a long distance or a short distance, and when the two push blocks 30 are pushed toward the driving head 51, the two push blocks 30 are moved through a long distance or a short distance, so that there are different manipulating manners between the two push blocks 30 and the main body 10.

9. The push rod 20, one of the two push blocks 30, and the first elastic member 40 are initially mounted on the main body 10, and the other one of the two push blocks 30 is then mounted on the main body 10 and locked onto the one of the two push blocks 30, so that the push rod 20, the two push blocks 30, and the first elastic member 40 are assembled without being limited by the space of the main body 10.

10. Referring to FIG. 11, the driving head 51 is disposed at a parallel operation state relative to the support arm 11. Thus, when the mounting member 19 is held by a user's hand, the handle 60 is rotated to drive and rotate the drive mechanism 50.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A wrench comprising:

a main body, two fitting members, a mounting member, a push rod, two push blocks, a first elastic member, a handle, and a drive mechanism;

wherein:

the main body has a first end provided with a support arm;

the support arm has a Y-shaped configuration;

the support arm has two pivoting portions provided on two ends thereof;

each of the two pivoting portions is a perforation;

each of the two pivoting portions has an internal thread;

the main body is provided with a rotation passage;

the rotation passage is arranged at a bottom of the support arm;

the rotation passage has a determined width and a determined depth;

the rotation passage has a rectangular shape;

the main body is provided with a first receiving hole;

the first receiving hole is arranged at the bottom of the support arm;

the first receiving hole is connected to the rotation passage;

the first receiving hole is a perforation;

the main body is provided with a first receiving slot;

the first receiving slot is connected to the first receiving hole;

the first receiving slot is a perforation;

the first receiving slot has two second receiving slots provided on two end faces thereof;

each of the two second receiving slots is connected to the first receiving slot;

each of the two second receiving slots has a length more than that of the first receiving slot and has a width more than that of the first receiving slot;

the first receiving slot is provided with a second receiving hole;

the second receiving hole aligns with the first receiving hole;

the second receiving hole is coaxial with the first receiving hole;

the second receiving hole has a circular shape;

the main body has a second end provided with a shank;

the shank has a circular shape;

the two fitting members are mounted on the two pivoting portions respectively;

each of the two fitting members has an end extending into and protruding from the support arm;

each of the two fitting members is a screw member;

the mounting member is provided with a first mounting portion;

the first mounting portion is pivotally mounted on the shank;

the mounting member is provided with a plurality of grooves;

the grooves increase a friction between the main body and a user's hand;

the grooves are arranged annularly;

the push rod is mounted in the first receiving hole;

the push rod is movable in the first receiving hole;

the push rod has a first end provided with a positioning element;

the positioning element protrudes from the first receiving hole;

the push rod has a second end provided with a second mounting portion;

the second mounting portion extends into the first receiving slot;

the second mounting portion has a diameter less than that of the push rod;

the two push blocks are combined mutually and mounted in the first receiving slot without detachment;

the two push blocks are moved linearly in the first receiving slot and drive the push rod to move axially in the first receiving hole;

each of the two push blocks is provided with a first received portion received in one of the of the two second receiving slots;

each of the two push blocks is provided with a second received portion received in the first receiving slot;

the second received portion of each of the two push blocks is provided with a third mounting portion;

the third mounting portions of the two push blocks are mounted on the second mounting portion respectively, so that the two push blocks and the push rod are assembled;

the two push blocks drive the push rod to move axially;

the second received portion of each of the two push blocks has a first end provided with a first locking section and a second locking section;

the first locking section and the second locking section construct an L-shaped piece;

the second received portion of each of the two push blocks has a second end provided with a first locking groove and a second locking groove;

the first locking groove and the second locking groove construct an L-shaped channel;

the first locking section of one of the two push blocks is received in the first locking groove of the other one of the two push blocks, and the second locking section of the one of the two push blocks is locked in the second locking groove of the other one of the two push blocks, so that the two push blocks are assembled;

the first elastic member is mounted in the second receiving hole;

the first elastic member is biased elastically between a bottom of the second receiving hole and the push rod;

the first elastic member provides a restoring force to the push rod when the push rod is moved in the main body;

the handle is mounted on the shank;

the handle restricts the mounting member;

the drive mechanism is pivotally mounted on the support arm;

the drive mechanism is provided with a "PUSH" structure that is normal in the hand tool industry;

the drive mechanism is operated in a two-way manner or in a one-way manner;

the drive mechanism includes a driving head, a control rod, and a second elastic member;

the driving head is provided with two fitting portions;

the two fitting portions align with the two pivoting portions respectively;

each of the two fitting members extends through one of the two pivoting portions and is fitted into one of the two fitting portions, so that the driving head is pivotally mounted on the two pivoting portions;

the driving head is rotated on the support arm with the two pivoting portions functioning an axis;

the driving head is provided with a third receiving hole;

the third receiving hole has an axis perpendicular to that of the two fitting portions;

the third receiving hole penetrates the driving head;

the driving head has an outer face provided with multiple first positioning portions;

the first positioning portions are arranged between the two fitting portions;

each of the first positioning portions is movable to align with the positioning element;

the positioning element pushes and locates one of the first positioning portions, so that the driving head is positioned on the main body by the push rod;

the driving head has three first positioning portions;

each of the first positioning portions is a cavity;

the driving head is provided with an operation end;

the operation end passes the rotation passage when the driving head is rotated, so that the driving head is rotated through 360 degrees;

when the two push blocks are pushed toward the handle and moved through a maximum distance, the push rod is driven and moved by the two push blocks, and the positioning element is retracted into and hidden in the first receiving hole, so that the operation end is moved to pass the rotation passage;

the control rod is mounted in the third receiving hole;

the control rod has a first end provided with a second positioning portion;

the second positioning portion has a recess;

the positioning element pushes and locates the second positioning portion;

when the push rod is moved, the second positioning portion is pushed and moved, and the control rod is moved in the third receiving hole;

the control rod has a second end provided with a stepped portion;

the stepped portion is moved to align with the operation end so that a socket mounted on the operation end is removed quickly; and the second elastic member is mounted on the control rod so that the control rod is movably elastically.

2. The wrench as claimed in claim 1, wherein when the second positioning portion aligns with the positioning element, the two push blocks are pushed toward the drive mechanism and moved through a determined distance, and the positioning element is moved to press the second positioning portion, so that the control rod is pushed and moved by the push rod, and the second elastic member is compressed.

3. The wrench as claimed in claim 1, wherein:

when the two push blocks are pushed toward the handle and moved through a long distance, the push rod is driven and moved toward the handle, so that the positioning element is retracted into the first receiving hole; and the operation end is moved to pass the rotation passage, so that the driving head is rotated freely through 360 degrees relative to the support arm.

4. The wrench as claimed in claim 1, wherein the operation end is a hexagonal head.

5. The wrench as claimed in claim 1, wherein the operation end is a square recess.

6. The wrench as claimed in claim 1, wherein the operation end is a hexagonal recess.

* * * * *